US006481581B2

(12) United States Patent
Sipe

(10) Patent No.: US 6,481,581 B2
(45) Date of Patent: Nov. 19, 2002

(54) LOCKABLE RACK FOR SKATEBOARDS, SCOOTERS AND INLINE SKATES

(76) Inventor: Thomas Sipe, 5421 Nelson St., Cypress, CA (US) 90630

( * ) Notice: Subject to any disclaimer, the term of this patent is extended or adjusted under 35 U.S.C. 154(b) by 0 days.

(21) Appl. No.: 09/804,163

(22) Filed: Mar. 12, 2001

(65) Prior Publication Data

US 2002/0030025 A1 Mar. 14, 2002

Related U.S. Application Data

(63) Continuation-in-part of application No. 09/659,429, filed on Sep. 8, 2000, now abandoned.

(60) Provisional application No. 60/160,450, filed on Oct. 21, 1999.

(51) Int. Cl.[7] ..... A47F 5/00

(52) U.S. Cl. ..... 211/4; 211/85.7; 211/87.01; 248/552; D6/552; 70/58

(58) Field of Search ..... 211/85.7, 87.01, 211/4, 8, 60.1; 70/58; 248/551, 552; D6/552

(56) References Cited

U.S. PATENT DOCUMENTS 2,046,815 A * 7/1936 Fike
2,472,058 A * 6/1949 Artley
D207,453 S * 4/1967 Hoffman
4,155,458 A 5/1979 Moline
4,337,883 A 7/1982 Pate
4,773,239 A 9/1988 Lowe et al.
4,911,310 A * 3/1990 Raishe et al. ..... 211/87.01
4,984,693 A * 1/1991 Belokin et al. ..... 211/88.01
5,040,385 A 8/1991 Randone
5,071,012 A * 12/1991 Jailor ..... 211/87.01 X
5,120,012 A 6/1992 Rosenau
5,154,313 A * 10/1992 Lichac et al.
5,160,048 A 11/1992 Leyden et al.
5,179,847 A 1/1993 Dorn
D342,637 S 12/1993 Smith
5,301,818 A 4/1994 Dix
5,305,897 A 4/1994 Smith
5,582,044 A 12/1996 Bolich
5,706,680 A 1/1998 Wroble
5,901,588 A 5/1999 Frost
D425,745 S 5/2000 Harris et al.
6,293,412 B1 * 9/2001 Draper ..... 211/4

* cited by examiner

*Primary Examiner*—Robert W. Gibson, Jr.
(74) *Attorney, Agent, or Firm*—Joseph E. Mueth

(57) ABSTRACT

A wall mountable rack for supporting and securing a skateboard, scooter or inline skate having one or a pair of wheels in proximity to each end of a board, footpiece or shoe by at least one of its wheels while allowing the board, footpiece or shoe and the remaining wheels or pair of wheels to hang below the rack.

5 Claims, 2 Drawing Sheets

2/2

LOCKABLE RACK FOR SKATEBOARDS, SCOOTERS AND INLINE SKATES

RELATED APPLICATIONS

This application claims the benefit of Provisional Patent Application Serial No. 60/160,450 filed on Oct. 21, 1999.

This application is a continuation-in-part of U.S. patent application Ser. No. 09/659,429, filed Sep. 8, 2000, now abandoned, the disclosure of which is expressly incorporated herein by reference.

BACKGROUND OF INVENTION

1. Field of Invention

This invention related to skateboard racking and locking devices, specifically to an improved device for storing and locking skateboards, scooters and similar sporting equipment.

2. Description of Relevant Prior Art

The popularity of skateboards among youths and young adults continues to grow at a rapid pace. For many, in addition to traditional recreational uses, skateboards have become an effective means of transportation. With this increase in popularity and uses has come a growing need for a durable, solid device for storing and locking skateboards at public places such as schools, parks and malls. Shortcomings in existing products render them unsatisfactory and unsuitable. A need therefore exists for a permanently mounted device that secures and safeguards skateboards at these types of public places.

Existing devices for storing and securing skateboards lack the combination of features necessary to protect this equipment effectively. Although several products are geared towards storing and/or securing skateboards, each of these products contains disadvantages and drawbacks that must be addressed to provide an effective and workable security device. In general, the current relevant art provides for either a device for holding skateboards or a device for locking skateboards. None of these devices however, combines the advantages of providing a permanent, secure holder that functions also as an effective locking device.

A number of U.S. patents provide for basic skateboard holders or racks but do not include a locking mechanism. U.S. Pat. No. 4,337,883 to Pate (1982) describes a removable skateboard holder that is attached to the belt of a wearer for transporting a skateboard. However, this device is intended only as a means of transporting a skateboard and does not provide for a secure, mounted holder or a locking mechanism. U.S. Pat. No. 5,120,012 to Rosenau (1991), U.S. Pat. No. 5,301,818 to Dix (1994), and U.S. Pat. No. 5,305,897 to Smith (1994) each describes a device for mounting or holding a skateboard or other skating device, but does not provide for a locking mechanism.

Each of the U.S. patents that provide for a skateboard locking mechanism has shortcomings that the present invention overcomes. U.S. Pat. No. 4,773,239 to Lowe (1988) describes a combination skateboard lock and trick device. However, this lock device is not mounted permanently to a fixed structure and requires the existence of a bicycle rack or post on which to affix the lock device. Without such a bicycle rack or post, the lock device, is completely ineffective. Further the Lowe patent leaves the front wheel truck of the skateboard exposed and thus vulnerable to theft or vandalism.

SUMMARY OF INVENTION

The invention which comprises a wall mountable rack for supporting and securing a skateboard, scooter or inline skate having one or a pair of wheels in proximity to each end of a board, footpiece or shoe by at least one of its wheels while allowing the board, footpiece or shoe and the remaining wheel or pair of wheels to hang below the rack, comprising a rear plate, a front plate and a floor plate running between said front and rear plates, an opening in said front plate to permit said board, footpiece or shoe to be held outside said front plate while one of said wheels or pair of wheels is received and carried on said floor plate between said front and rear plates, an overlying closure plate running between said front and rear walls which is adapted to be opened to position said wheel or pair of wheels between said front and rear plates and then locked in place over the top of said wheel or pair of wheels to prevent the removal of said wheel or pair of wheels from that position thereby securing the skateboard, scooter or inline skate.

More particularly, the invention which comprises a wall mountable rack for supporting and securing a skateboard by one pair of its wheels while allowing the board and the remaining pair of wheels to hang below the rack, comprising a rear plate, a front plate and a floor running between said front and rear plates, an opening in said front plate to permit said board to be held outside said front plate while said one pair of wheels is received and carried on said floor plate between said front and rear plates, an overlying closure plate running between said front and rear walls which is adapted to be opened to position said one pair of wheels between said front and rear plates and then locked in place over the top of said one pair of wheels to prevent the removal of said one pair of wheels from that position thereby securing the skateboard.

In another aspect, the invention which comprises a wall mountable rack for supporting a skateboard by one pair of its wheels while allowing the board and the remaining pair of wheels to hang below the rack, comprising a rear plate, a front plate and a floor running between said front and rear plates, an opening in said front plate to permit said board to be held outside said front plate while said one pair of wheels is received and carried on said floor plate between said front and rear plates.

THE DRAWINGS

DESCRIPTION OF PREFERRED EMBODIMENTS

In one preferred embodiment, the present invention comprises a steel rectangularly-shaped box with a T-shaped cutout of the center top plate and front plate, a solid bottom plate, hinges attached to the rear plate, a lock hasp attached to the lid, and a wooden base attached to the rear plate. The invention is permanently attached to a vertical structure, such as a wall, by lag screws, bolts, anchors or combinations of various affixing methods.

Figure 5:
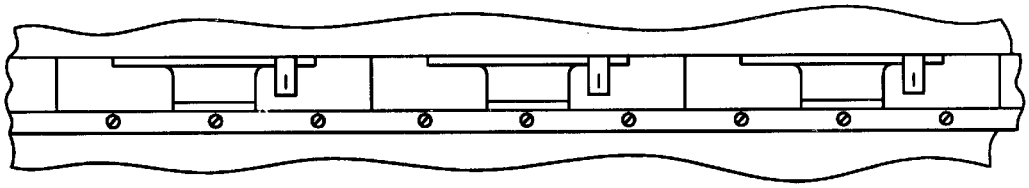
FIG. 5 is a top view of an alternate embodiment of this invention.

According to another embodiment of the invention, as shown in FIG. 5, multiples of the embodiment of FIGS. 1 to 4 are combined into one device to hold and lock a number of skateboards.

Figure 6:
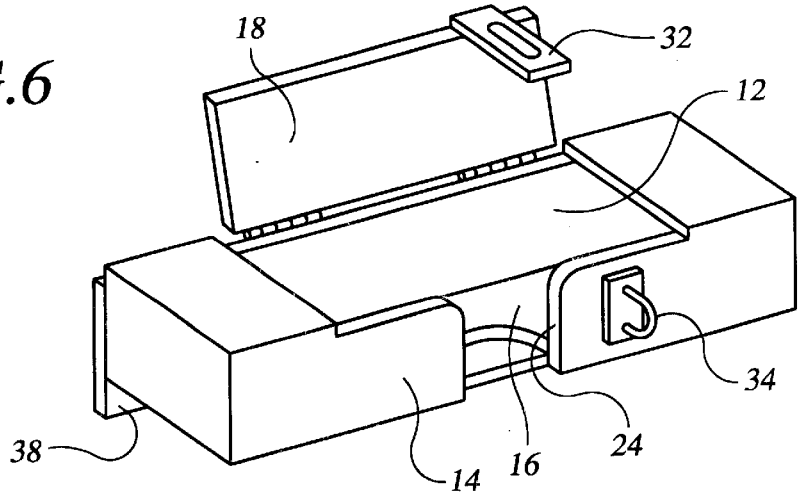
FIG. 6 is a perspective view of another embodiment of this invention.

According to yet another embodiment, as shown in FIG. 6, a U-shaped cutout in the center of the bottom plate enables the device to hold and lock a scooter.

Figure 7:
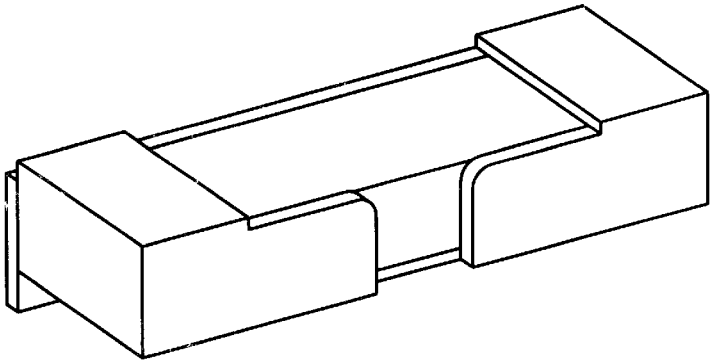
FIG. 7 is a perspective view of an embodiment where the rack holds a skateboard for storage where security is not paramount.

According to a further embodiment, as shown in FIG. 7, removal of the top plate, the hinges and the lock hasp enables the device to hold or store a skateboard, scooter or in-line skates in the homes.

Figure 1:
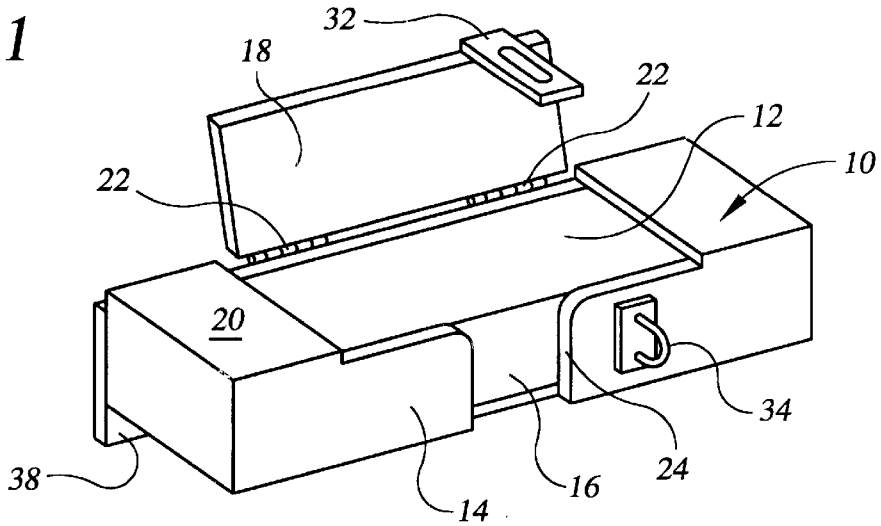
FIG. 1 is a perspective view of a preferred embodiment of the wall mountable rack of this invention.
Figure 2:
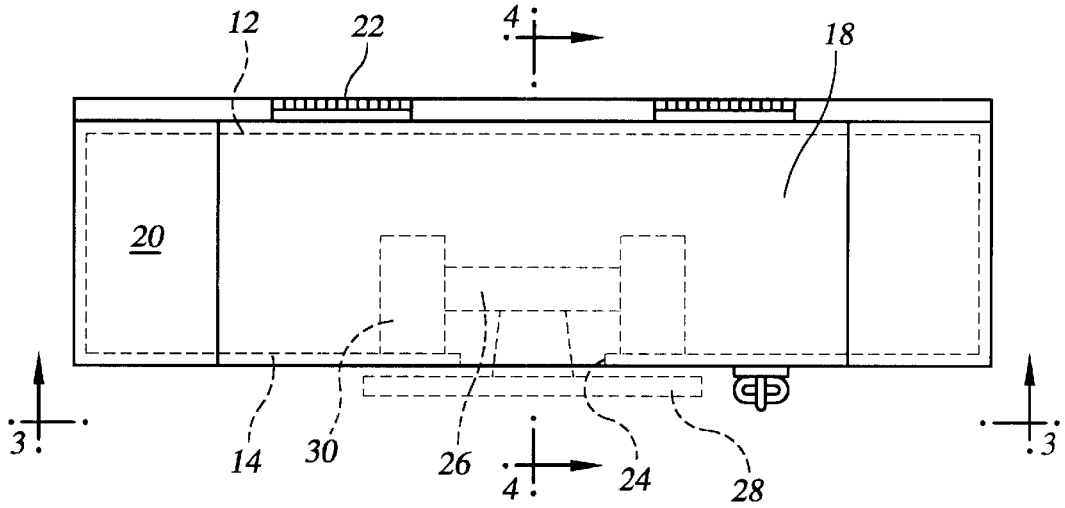
FIG. 2 is a top plan view of the wall mountable rack of FIG. 1 with a skateboard locked in place.
Figure 3:
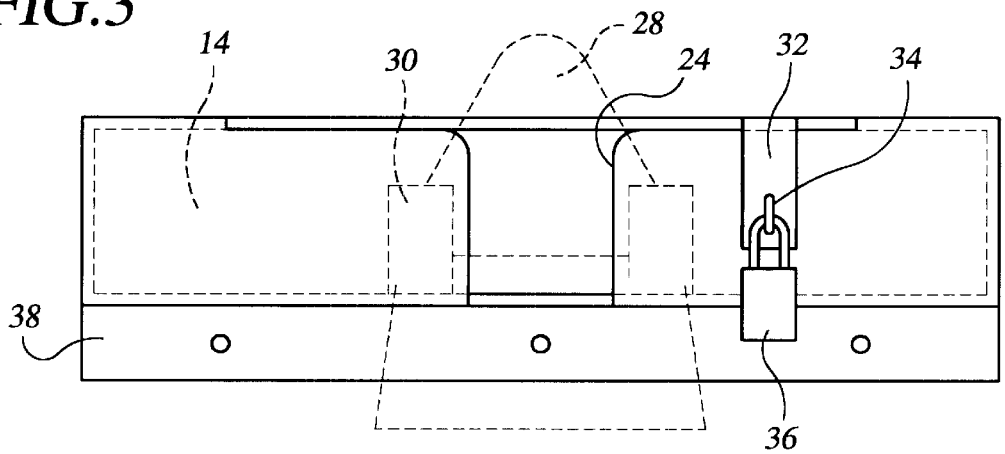
FIG. 3 is a front plan view of the wall mounted rack of FIGS. 1 and 2 with a skateboard locked in place.
Figure 4:
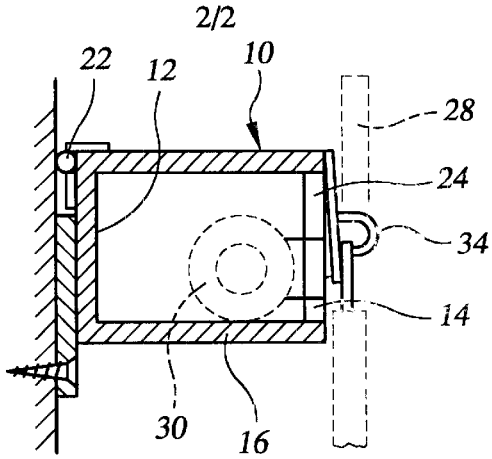
FIG. 4 is a sectional view taken along the lines 4—4 in FIG. 2.

Turning to the main embodiment of the present invention as illustrated in FIGS. 1 to 4, a wall-mounted lockable skateboard rack is comprised of a rectangularly shaped box 10, preferably made of 3-inch tubular steel and having a length of 16 inches. The box 10 has a rear plate 12, front plate 14 and bottom plate 16. The box 10 has a top plate or lid 18 in top 20 which is carried by pair of hinges 22. The locking portion of the rack is a T-shaped cutout formed by the cutout 24 in front plate 14 and the top opening provided by the lifting of lid 18, as shown in FIG. 1. The hinges 22 are attached to the rear plate 12. The lid 18, preferably measuring 3 inches wide and 11 inches in length, is adapted to close over the skateboard trucks. The typical skateboard has a truck 26 in proximity to each end of the board 28, each truck 26 comprising a pair of wheels 30. A lock hasp cover 32 is attached to the lid 18 which when pulled over the lock hasp 34 and completed with a key or combination lock 36 provides a much needed and secure device for locking and securing a skateboard to the rack. A base 38, commonly made of wood, is attached to the rear plate 12 to provide a method for securing the invention to a wall or similar structure.

The rack is preferably made of steel.

The manner for using the present invention is straightforward. Secure the skateboard rack to a sturdy structure, such as a wall or similar structure, at base 38 with lag screws or anchor bolts or other appropriate affixing methods known to those skilled in the art. Place the skateboard trucks 26 in the T-shape cutout with the pair of wheels positioned between rear plate 12 and front plate 14, and resting on bottom plate 16. Pull down lid 18 over the skateboard trucks 26 and complete by pulling lock hasp cover 32 into place over lock hasp 34 and securing with a key or combination lock 36.

The embodiment of FIG. 5 provides multiple skateboard racks in one device by combining and interconnecting any number of the individual devices depicted in FIGS. 1 to 4.

The additional embodiment shown in FIG. 6 provides an effective mounting device for securing and locking scooters in public places. A U-shaped cutout 40 in the bottom plate 16 provides a slot in which to mount a scooter having a footpiece provided with front and rear trucks, each having a pair of wheels. One of the pair of wheels is held in the rack in the manner generally as depicted in FIGS. 1 to 4.

Inline skates; can similarly be secured in the device shown in FIG. 6. The manner for using this additional embodiment is identical to that of the main embodiment described above. It is to be understood that the skates can be held in the rack with or without the shoe since inline skates are provided as an attachment to shoes or as an integral part of so-called shoe skates.

Yet another embodiment as shown in FIG. 7, provides an effective device for mounting skateboards, scooters or in-line skates at home. The lid 18 and lock hasp 34 are removed to provide a solid durable device for mounting this equipment in places where the risk of theft is not great such as in homes and garages. This additional embodiment promotes safety at home by providing a device for storing potentially dangerous skateboards, scooters or in-line skates when they are not in use.

Accordingly, the invention provides an improved and reliable device for storing and locking skateboards. The present invention provides several important advantages over the prior relevant art. Because the invention is permanently affixed to a vertical structure at places such as schools, parks and malls, it is durable and effective as a theft-deterrent device. Moreover, this attribute of the invention precludes the need for a bicycle rack or a pole on which to attach the locking device. It also preclude the need for the user to transport a locking device to these public places.

Furthermore, the invention has additional advantages in that it is economical, reliable and durable. It also will minimize the risks associated with leaving skateboards, scooters and similar equipment on the ground when not in use, and it will encourage skateboard and scooter users not to carry their equipment into school or the mall.

Although the description above contains many specificities, these should not be construed as limiting the scope of the invention but as merely providing illustrations of some of the presently preferred embodiments of this invention. Other embodiments and ramifications of the invention are possible as well. For example, the invention may be used to secure sporting equipment other than skateboards, scooters, and skates.

What is claimed is:

1. A wall mountable rack for supporting and securing a skateboard, scooter or inline skate having one or a pair of wheels in proximity to each end of a board, footpiece or shoe by at least one of its wheels while allowing the board, footpiece or shoe and the remaining wheels or pair of wheels to hang below the rack, comprising a rear plate, a front plate and a floor plate running between said front and rear plates, an opening in said front plate to permit said board, footpiece or shoe to be held outside said front plate while one of said wheels or pair of wheels is received and carried on said floor plate between said front and rear plates, a overlying closure plate running between said front and rear walls which is adapted to be opened to position wheel or pair of wheels between said front and rear plates and then locked in place over the top of said wheel or pair of wheels to prevent the removal of said wheel or pair of wheels from that position thereby securing the skateboard, scooter or inline skate.

2. The lockable rack of claim 1 further including the interconnection of said lockable rack to form multiple racks in one device.

3. The lockable rack of claim 1 wherein said floor plate includes a U-shaped cutout to hold a scooter.

4. The lockable rack of claim 1 wherein said rack is composed of steel.

5. A wall mountable rack for supporting and securing a skateboard by one pair of its wheels while allowing the board and the remaining pair of wheels to hang below the rack, comprising a rear plate, a front plate and a floor running between said front and rear plates, an opening in said front plate to permit said board to be held outside said front plate while said one pair of wheels is received and carried on said floor plate between said front and rear plates, a overlying closure plate running between said front and rear walls which is adapted to be opened to position said one pair of wheels between said front and rear plates and then locked in place over the top of said one pair of wheels to prevent the removal of said one pair of wheels from that position thereby securing the skateboard.

* * * * *